US006191387B1

(12) United States Patent
Smal

(10) Patent No.: US 6,191,387 B1
(45) Date of Patent: Feb. 20, 2001

(54) HAIR STYLING TONGS WITH BIASED HANDLES

(75) Inventor: Henri Smal, Blegny (BE)

(73) Assignee: Conair Corporation, Stamford, CT (US)

( * ) Notice: Under 35 U.S.C. 154(b), the term of this patent shall be extended for 0 days.

(21) Appl. No.: 09/367,570

(22) PCT Filed: Feb. 13, 1998

(86) PCT No.: PCT/BE98/00020

§ 371 Date: Jan. 26, 2000

§ 102(e) Date: Jan. 26, 2000

(87) PCT Pub. No.: WO98/35578

PCT Pub. Date: Aug. 20, 1998

(30) Foreign Application Priority Data

Feb. 17, 1997 (BE) ..... 9700146

(51) Int. Cl.[7] ..... A45D 2/00

(52) U.S. Cl. ..... 219/225; 219/227; 132/224; 294/99.2; 294/16

(58) Field of Search ..... 219/225, 227–229, 219/524; 132/224, 225, 269; 81/9.4, 9.44; 294/99.2, 34, 16, 50.8

(56) References Cited

U.S. PATENT DOCUMENTS 1,033,122 * 7/1912 Schwartz ..... 219/225
1,455,696 * 5/1923 Wright ..... 219/225
1,643,456 * 9/1927 James ..... 294/50.8
1,852,269 * 4/1932 Siers ..... 132/225
3,304,111 * 2/1967 Kauh et al. ..... 294/99.2
3,703,042 * 11/1972 Smith ..... 38/69

FOREIGN PATENT DOCUMENTS

386644 * 2/1922 (DE) .
2455114 * 5/1976 (DE) ..... 294/99.2
325570 * 6/1936 (IT) ..... 132/25

* cited by examiner

*Primary Examiner*—John A. Jeffery
(74) *Attorney, Agent, or Firm*—Ohlandt, Greeley, Ruggiero & Perle

(57) ABSTRACT

Hairdressing tongs have a pair of arms extending from handles. Each arm has a heating pad affixed thereto. The handles have opposed openings. A central element is positioned between the handles and fitted within the openings such that the central element is slidable toward the handles. The central element has guide openings. Springs are positioned in the guide openings for biasing apart the handles. The springs enable hand pressure to move the handles and arms together from a completely open position to a completely closed position and, in absence of the hand pressure, to maintain the handles and arms in relatively parallel configuration, biased against stops of the central element.

16 Claims, 4 Drawing Sheets

HAIR STYLING TONGS WITH BIASED HANDLES

SUBJECT OF THE INVENTION

The invention relates to hairdressing tongs for straightening/styling.

TECHNICAL BACKGROUND

Hairdressing tongs which consist of two heating pads and can be equipped with a water reservoir for simultaneous emission of steam have already been offered on the market. The pads, fixed to the end of two handle arms connected by a pivot and a spring, hold the two arms apart from one another in the rest position.

By acting on the handle using the hand, it is possible, starting from a position of maximum opening, to move the two arms, and therefore the pads which are integral therewith, towards one another through a variable acute angle to, at the end of travel, bring the pads into contact and in principle into a parallel position.

Locks of hair are gripped between the heating pads and the hair can thus be smoothed by making it slide between the hot pads, if necessary with an emission of steam obtained from water originating from a reservoir incorporated in the support of one heating pad, in contact with which the water evaporates.

This type of angular-opening tongs has the fundamental disadvantage that it cannot easily be adapted to different types of hair and in particular, with a constant lock thickness, that it acts on the gripped hair on one side more than the other. In fact, in the case of arms articulated about a common axis, the angle between the pads varies constantly according to the separation. The pads therefore follow only imperfectly the shape of the locks of hair. This device also does not allow the user to achieve all the desired shaping effects.

THE AIM OF THE INVENTION

The aim of the present invention is to avoid the above-mentioned disadvantages and in particular it seeks to make it possible for the two arms constituting the handle to be opened otherwise than solely angularly.

In particular, the aim is to provide hairdressing tongs which allow the user to modify the gripping effect according to the hairdressing effects it is desired to achieve.

CHARACTERISTIC FEATURES OF THE INVENTION

The hairdressing tongs according to the invention comprise, in a conventional manner, heating pads fixed to the end of two arms of a handle. The two arms are, however, mounted in a floating manner in the sense that a central element of the handle serves as a guide for these arms which can thus be moved transversely from a completely contracted position, the hand being closed and the two heating pads being brought into complete contact, to a position of maximum separation, bringing the arms into a position of contact with the stops of the central element, spring elements maintaining this maximum separation in the absence of action on the arms of the handle, that is to say in the rest position.

By holding, with the hand, the rear face of the arms in a completely pushed-in position and by pushing the front face of these arms in gradually, the tongs are closed in the conventional, that is to say angular, manner. However, it is possible to press in an identical manner on the front and rear faces of the arms of the handle, in this case closing the pads in a parallel manner and perfectly in contact with the entire lock of hair. By accentuating the pressure towards the front, the pads move towards one another at the tip, which makes it possible, for example, to deal accurately with very short hair or to make adjustments.

This method of articulation makes it possible to transmit all the dexterity of the user to the pads.

Depending on whether the pressure is balanced on the front or the rear of the handle, or whether the pressure is accentuated towards the front or towards the rear, the pads move towards one another in a parallel manner or favouring contact towards the front or the rear. They can thus follow perfectly the shape of the lock of hair whatever the thickness and regularity of the latter.

Advantageously, the arms of the handle have the straps of half-shells surrounding the central handle element.

The central handle element is perforated by two openings, one at the front and the other at the rear, which allow the passage of a spring working under compression. Each spring pushes the two arms away from one another until contact is made with a stop on the central element. Preferable, a stud or other fixing element retains the end of the spring in place.

Various accessories which facilitate the hairdressing operation can be incorporated in the tongs which have just been described as will emerge from the description below of a preferred embodiment of the invention.

BRIEF DESCRIPTION OF THE DRAWINGS

The same reference numbers are used in the various figures for identical or similar elements.

DESCRIPTION OF AN EMBODIMENT OF THE INVENTION

Figure 1:
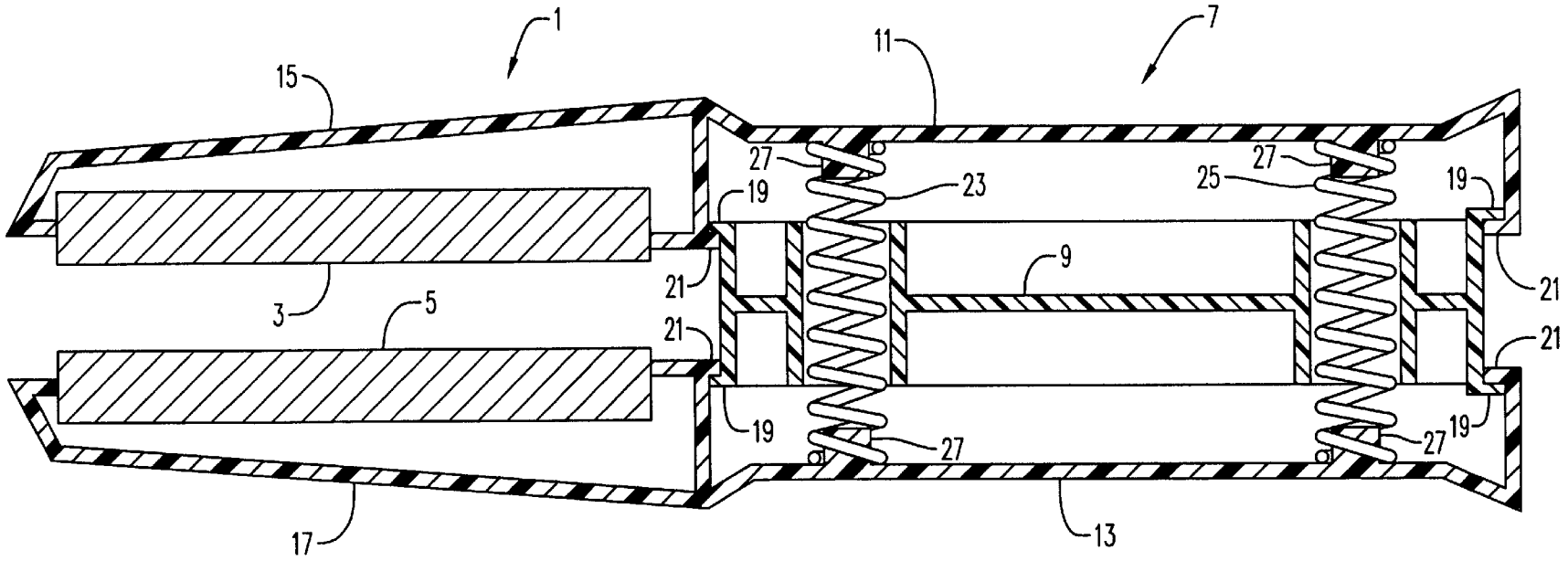
FIG. 1 shows a view in section of hairdressing tongs according to the invention (limited to the essential components)

The hairdressing tongs shown by the general reference 1 comprise two heating pads 3 and 5 connected to a handle 7. Handle 7 is made of molded plastic materials. These pads are provided with electric resistors (not shown) fed by an electric wire running through the handle 7. Heating pads 3 and 5 are made of heat conductive materials such as, but not limited to, metallic materials and ceramic materials. This handle 7 consists of a central element 9 and two arms 11 and 13.

The arm 11 extends in a nose 15 in which the heating pad 3 is mounted while the arm 13 extends in a nose 17 in which the heating pad 5 is mounted.

The central element 9 comprises stops 19 at its ends for steps 21 formed on the arms 11 and 13.

The springs 23 and 25, at the front and rear end respectively of the handle 7, are held by studs 27 and separate the arms 11 and 13, and consequently also the heating pads 3 and 5, from one another.

Figure 2A:
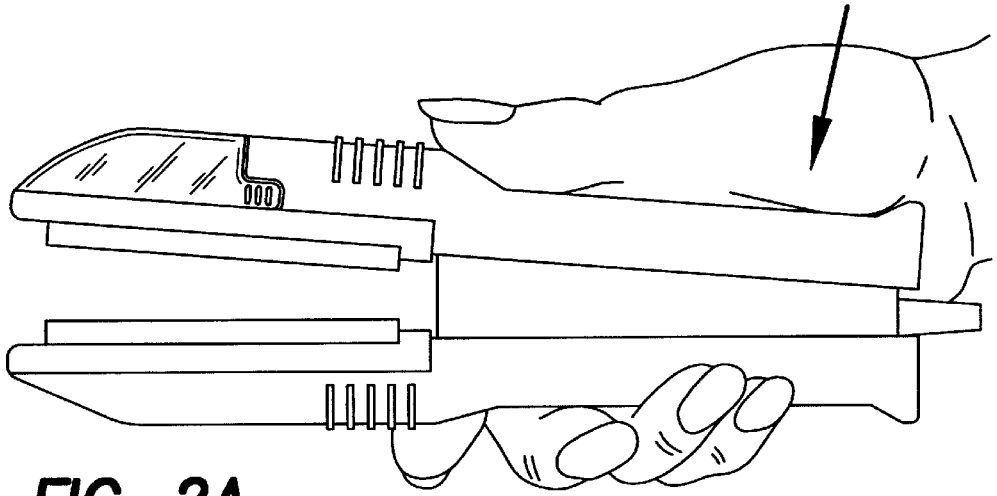
FIGS. 2A, 2B and 2C show hairdressing tongs according to the invention in three positions of use.
Figure 2B:
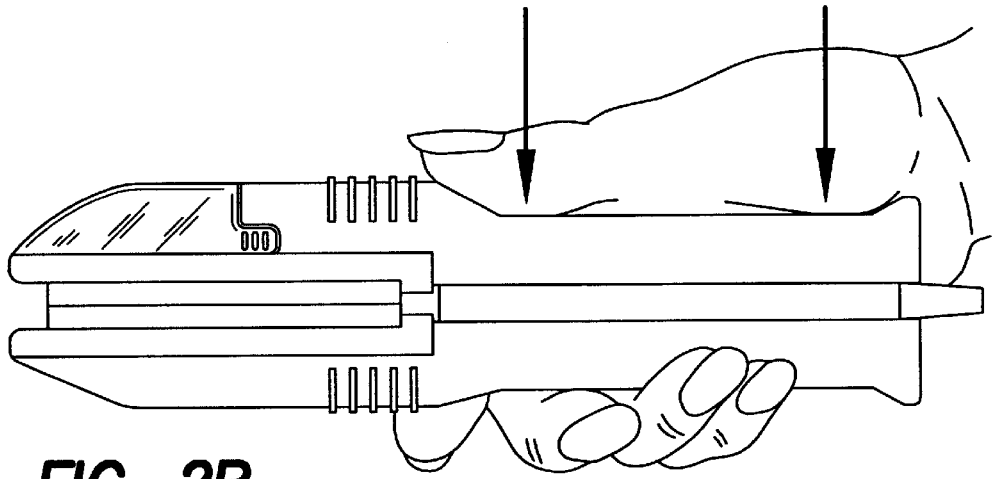
Figure 2C:
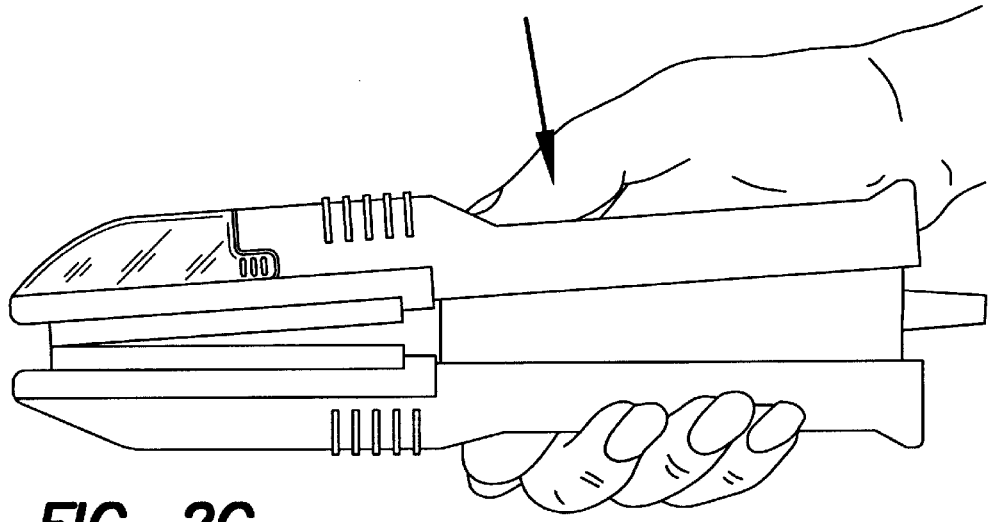

It is easy to see that by pressing (see FIG. 2A) on the rear of the tongs evenly, on the front and the rear (FIG. 2B) or on the front (FIG. 2C), the tongs and, more precisely, the heating pads can assume a position of angular separation, a parallel position or a position of gripping at the front of the heating pads. Other intermediate positions are possible, thus affording the user the possibility of carrying out all shaping styles.

The two arms 11 and 13 preferably have the shape of half-shells covering two lateral walls integral with the central element 9, the handle also being closed at its front end and at its rear end.

The upper nose 15 of the tongs can be provided with a reservoir 31 which can be removed to allow it to be filled and which communicates with the pad 3 in order, subject to the action of a control positioned for example on the handle 7, to give rise to the emission of steam on or between the pads.

Figure 3A:
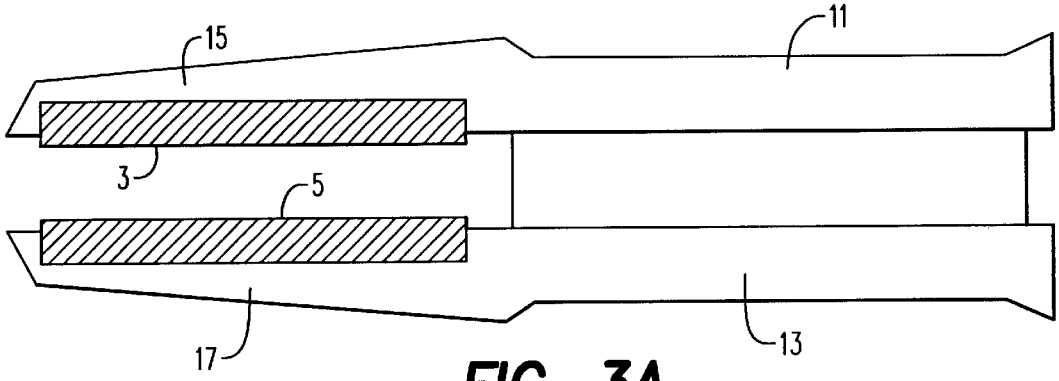
FIGS. 3A, 3B and 3C illustrate different possibilities for mounting the pads on the hairdressing tongs.

FIG. 3A shows noses 15 and 17 which extend the arms 11 and 13 and in which the pads 3 and 5 are mounted, the noses thus forming protection shells for the pads.

Figure 3B:
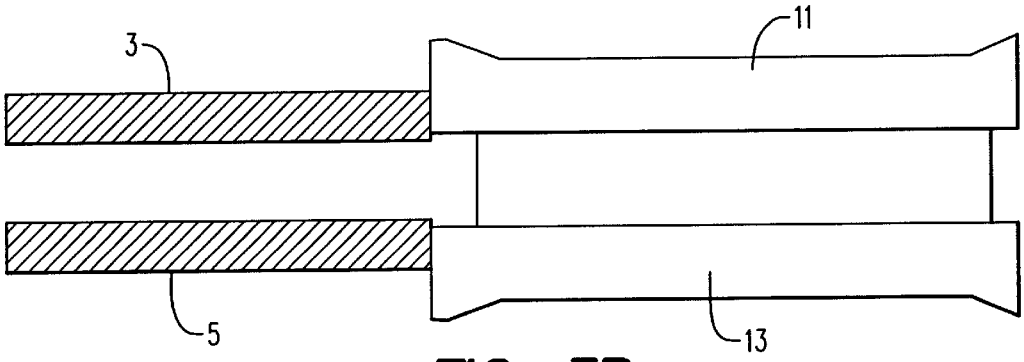

In the case of FIG. 3B, the heating pads 3 and 5 are mounted in a projecting manner on the end of the arms 11 and 13.

Figure 3C:
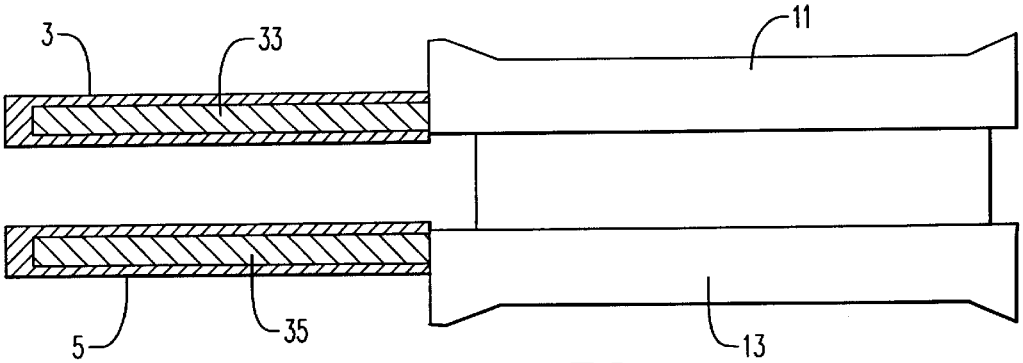

According to another variant shown in FIG. 3C, the heating pads 3 and 5 are slipped onto rods 33 and 35 integral with the arms 11 and 13.

The heating pads can be fixed or interchangeable and have any appropriate shape, namely flat, convex, concave, undulating etc.

The pads may also be axially orientable or reversible, depending on the requirements of users.

Figure 4:
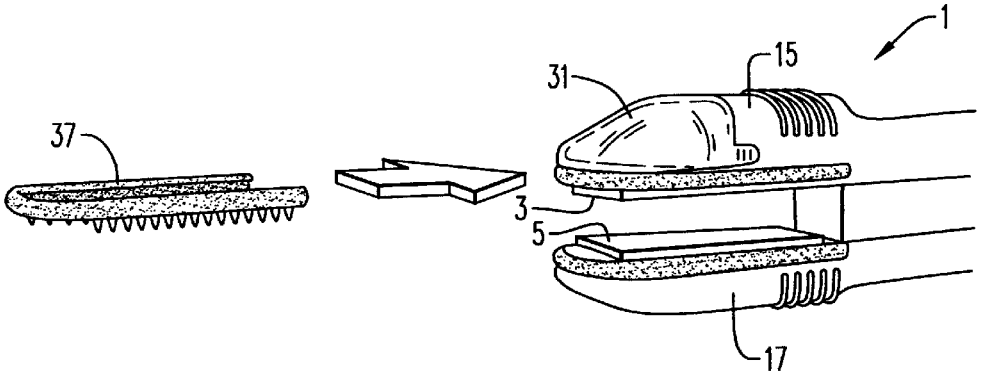
FIG. 4 illustrates the possibility of mounting accessories on the hairdressing tongs.

As FIG. 4 indicates, the nose 15 can be shaped so as to be capable of being provided with one or more adaptable elements 37 equipped for example with a double row of comb teeth.

Numerous variants are of course possible according to the invention while remaining within its scope as defined by the claims below.

What is claimed is:

1. Hairdressing tongs comprising:

a pair of arms extending from handles, each arm having a heating pad affixed thereto, said handles having opposed openings;

a central element positioned between said handles and fitted within said openings such that said handles are slidable towards said central element, said central element including at least two guide openings; and spring means positioned in each of said at least two guide openings for biasing apart said handles, said spring means enabling hand pressure to move said handles and said pair of arms together from a completely open position to a completely closed position, wherein said spring means in absence of said hand pressure maintains said handles and said pair of arms in relatively parallel configuration biased against stops of said central element.

2. Hairdressing tongs according to claim 1, wherein each said handle is in the shape of a half-shell that fits about said central element.

3. Hairdressing tongs according to claim 1, wherein said heating pads are mounted so as to project from said pair of arms.

4. Hairdressing tongs according to claim 1, wherein said heating pads are positioned on rods that are integral with said pair of arms.

5. Hairdressing tongs according to claim 1, wherein said heating pads are changeable.

6. Hairdressing tongs according to claim 1, wherein said at least two guide openings are two guide openings, and wherein said spring means are two springs, each guide opening including one said spring.

7. Hairdressing tongs according to claim 1, further comprising:

a reservoir for holding water in communication with at least one of said heating pads, an aperture in at least one of said pair of arms enabling emission of steam therefrom.

8. Hairdressing tongs according to claim 1, further comprising a removable toothed element that slidably fits on at least one said arm.

9. Hairdressing tongs comprising:

a central element including at least two guide openings;

a pair of half-shell shaped handles each having a front end and a back end, wherein said handles fit about said central element such that said handles are slidable toward said central element;

a pair of arms extending from said front ends of said handles, each arm having a heating pad affixed thereto;

spring means positioned within each of said at least two guide openings biasing said handles apart against stops of said central element, said spring means enabling hand pressure applied to said back end of said handles to move a first portion of said pair of arms together from a completely open position to a completely closed position and enabling hand pressure applied to said front end of said handles to move a second portion of said pair of arms together from a completely open position to a completely closed position.

10. Hairdressing tongs according to claim 9, wherein said first portion of said pair of arms is proximal said front ends of said pair of handles and said second portion of said pair of arms is distal said front ends of said pair of handles.

11. Hairdressing tongs according to claim 9, wherein each of said heating pads is mounted to project from a different one of said pair of arms.

12. Hairdressing tongs according to claim 9, wherein said heating pads are positioned on rods that are integral with said pair of arms.

13. Hairdressing tongs according to claim 9, wherein said heating pads are changeable.

14. Hairdressing tongs according to claim 9, wherein said at least two guide openings comprises two guide openings, and wherein said spring means comprises two springs, each one of said two guide openings includes one of said springs.

15. Hairdressing tongs according to claim 9, further comprising:

a reservoir for holding water in communication with at least one said heating pads; and an aperture in at least one of said pair of arms to enable emission of steam therefrom.

16. Hairdressing tongs according to claim 9, further comprising a removable toothed element that slidably fits on at least one of said pair of arms.

* * * * *